US005658402A

United States Patent [19]

Kawana et al.

[11] Patent Number: 5,658,402

[45] Date of Patent: Aug. 19, 1997

[54] HIGH-CARBON STEEL WIRE ROD AND WIRE EXCELLENT IN DRAWABILITY AND METHODS OF PRODUCING THE SAME

[75] Inventors: Akifumi Kawana; Hiroshi Oba; Ikuo Ochiai; Seiki Nishida, all of Chiba-ken, Japan

[73] Assignee: Nippon Steel Corporation, Tokyo, Japan

[21] Appl. No.: 545,675

[22] PCT Filed: Apr. 6, 1994

[86] PCT No.: PCT/JP94/00576

§ 371 Date: Oct. 31, 1995

§ 102(e) Date: Oct. 31, 1995

[87] PCT Pub. No.: WO94/28189

PCT Pub. Date: Dec. 8, 1994

[30] Foreign Application Priority Data

May 25, 1993 [JP] Japan ..... 5-122984

[51] Int. Cl.[6] ..... C21D 8/06; C22C 38/02

[52] U.S. Cl. ..... 148/595; 148/598; 148/320

[58] Field of Search ..... 148/598, 595, 148/320

[56] References Cited

FOREIGN PATENT DOCUMENTS

| | | | |
|---|---|---|---|
| 405105965 | 4/1993 | Japan | 148/598 |
| 8001083 | 5/1980 | WIPO | 148/320 |

*Primary Examiner*—Deborah Yee

*Attorney, Agent, or Firm*—Wenderoth, Lind & Ponack

[57] ABSTRACT

This invention relates to high-carbon steel wire rod and wire excellent in drawability and methods of producing the same.

The high carbon steel wire rod or wire excellent in is characterized in that it contains, in weight percent, C: 0.70–1.20%, Si: 0.15–1.00% and Mn: 0.30–0.90%, further contains as alloying components one or both of Al: 0.006–0.100 and Ti: 0.01–0.35%, is limited to P: not more than 0.02% and S: not more than 0.01%, the remainder being Fe and unavoidable impurities, and has a microstructure of, in terms of area ratio, not less than 80% upper bainite texture obtained by two-stepped transformation and an Hv of not more than 450. The high-carbon steel wire rod or wire may additionally contain Cr: 0.10–0.50% as an alloying component.

The present invention enables production of high-carbon steel wire rod or wire excellent in ductility, elimination of intermediate heat treatment in the secondary processing step, a large reduction in cost, a shortening of production period, and a reduction of equipment expenses.

10 Claims, 1 Drawing Sheet

HIGH-CARBON STEEL WIRE ROD AND WIRE EXCELLENT IN DRAWABILITY AND METHODS OF PRODUCING THE SAME

TECHNICAL FIELD

This invention relates to high-carbon steel wire rod and wire excellent in drawability and methods of producing the same.

BACKGROUND ART

Wire rod and wire are ordinarily drawn into a final product matched to the purpose of use. Before conducting the drawing process, however, it is necessary to put the wire rod or wire in a condition for drawing.

As a conventional measure for this, Japanese Patent Publication No. Sho 60-56215 discloses a method for heat treatment of steel wire rod of high strength and small strength variance characterized in that wire rod of steel containing C: 0.2–1.0%, Si<0.30% and Mn: 0.30–0.90% and at austenite formation temperature is cooled between 800° and 600° C. at a cooling rate of 15°–60° C./sec by immersion in fused salt of one or both of potassium nitrate and sodium nitrate fused by heating to a temperature or 350°–600° C. and stirred by a gas.

However, the wire rod of pearlite texture obtained by the heat treatment method described in the aforesaid patent publication involves the problems or ductility degradation during drawing at a high reduction of area and of cracking in twist testing (hereinafter referred to as "delamination").

The object of this invention is to provide high-carbon steel wire rod and wire excellent in drawability and methods of producing the same which advantageously overcome the aforesaid problems of the prior art.

DISCLOSURE OF THE INVENTION

The gist of the invention is as set out below.

(1) High-carbon steel wire rod or wire excellent in drawability characterized in that it contains, in weight percent,

C: 0.70–1.20%,

Si: 0.15–1.00% and

Mn: 0.30–0.90%, further contains as alloying components one or both of

Al: 0.006–0.100% and

Ti: 0.01–0.35%, is limited to

P: not more than 0.02% and

S: not more than 0.01%, the remainder being Fe and unavoidable impurities, and has a microstructure of, in terms of area ratio, not less than 80% upper bainite texture obtained by two-stepped transformation and an Hv of not more than 450.

(2) High-carbon steel wire rod or wire excellent in drawability according to paragraph 1 above further containing Cr: 0.10–0.50% as an alloying component.

(3) A method of producing high-carbon steel wire rod excellent in drawability characterized by, rolling into wire rod a steel slab of a composition which contains, in weight percent,

C: 0.70–1.20%,

Si: 0.15–1.00% and

Mn: 0.30–0.90%, further contains as alloying components one or both of

Al: 0.006–0.100% and

Ti: 0.01–0.35%, is limited to

P: not more than 0.02% and

S: not more than 0.01%, the remainder being Fe and unavoidable impurities, cooling the rolled wire rod from the temperature range of 1100°–755° C. to the temperature range of 350°–500° C. at a cooling rate of 60°–300° C./sec, and holding it in this temperature range for a specified time period within the range in which bainite transformation does not begin or within a range from after the start of bainite transformation to prior to completion of bainite transformation, and increasing the temperature and holding it until bainite transformation is completely finished.

(4) A method of producing high-carbon steel wire rod excellent in drawability according to paragraph B above wherein the starting slab further contains Cr: 0.10–0.50% as an alloying component.

(5) A method of producing high-carbon steel wire rod excellent in drawability according to paragraph 3 or 4 above characterized by, after the starting slab has been rolled into wire rod, cooling the rolled wire rod from the temperature range of 1100°–755° C. to the temperature range of 350°–500° C. at a cooling rate of 60°–300° C./sec, holding it in this temperature range for not less than 1 sec and not more than a period within the range in which bainite transformation does not begin of X sec determined by the following equation (1), and increasing the temperature not less than 10° C. and not more than 600–$T_1$ ($T_1$: holding temperature after cooling) °C. and holding it until bainite transformation is completely finished, $$X=\exp(16.03-0.0307\times T_1) \quad (1)$$

where $T_1$: holding temperature after cooling.

(6) A method of producing high-carbon steel wire rod excellent in drawability according to paragraph 3 or 4 above characterized by, after the starting slab has been rolled into wire rod, cooling the rolled wire rod from the temperature range of 1100°–755° C. to the temperature range of 350°–500° C. at a cooling rate of 60°–300° C./sec, holding it in this temperature range for a period from after the start of bainite transformation to prior to completion of bainite transformation, specifically for a period of not more than Y sec determined by the following equation (2), and increasing the temperature not less than 10° C. and not more than 600–$T_1$ ($T_1$: holding temperature after cooling) °C. and holding it until bainite transformation is completely finished, $$Y=\exp(19.83-0.0329\times T_1) \quad (2)$$

where $T_1$: holding temperature after cooling.

(7) A method of producing high-carbon steel wire excellent in drawability characterized by, heating to the temperature range of 1100°–755° C. wire of a composition which contains, in weight percent,

C: 0.70–1.20%,

Si: 0.15–1.00% and

Mn: 0.30–0.90%, further contains as alloying components one or both of

Al: 0.006–0.100% and

Ti: 0.01–0.35%, is limited to

P: not more than 0.02% and

S: not more than 0.01%, the remainder being Fe and unavoidable impurities, cooling the heated wire to the temperature range of 350°–500° C. at a cooling rate of 60°–300° C./sec, and holding it in this temperature range for a specified time period within the range in which bainite transformation does not begin or within a range from after the start of bainite transformation to prior to completion of bainite transformation, and increasing the temperature and holding it until bainite transformation is completely finished.

(8) A method of producing high-carbon steel wire excellent in drawability according to paragraph 7 above wherein the starting wire further contains Cr: 0.10–0.50% as an alloying component.

(9) A method of producing high-carbon steel wire excellent in drawability according to paragraph 7 or 8 above characterized by, cooling the starting wire from the temperature range of 1100°–755° C. to the temperature range of 350°–500° C. at a cooling rate of 60°–300° C./sec, holding it in this temperature range for not less than 1 sec and not more than a period within the range in which bainite transformation does not begin of X sec determined by the following equation (1), and increasing the temperature not less than 10° C. and not more than 600–$T_1$ ($T_1$: holding temperature after cooling) °C. and holding it until bainite transformation is completely finished, $$X=\exp(16.03-0.0307\times T_1) \quad (1)$$

where $T_1$: holding temperature after cooling.

(10) A method of producing high-carbon steel wire excellent in drawability according to paragraph 7 or 8 above characterized by, cooling the starting wire from the temperature range of 1100°–755° C. to the temperature range of 350°–500° C. at a cooling rate of 60°–300° C./sec, holding it in this temperature range for a period from after the start of bainite transformation to prior to completion of bainite transformation, specifically for a period of not more than Y sec determined by the following equation (2), and increasing the temperature not less than 10° C. and not more than 600–$T_1$ ($T_1$: holding temperature after cooling) °C. and holding it until bainite transformation is completely finished, $$Y=\exp(19.83-0.0329\times T_1) \quad (2)$$

where $T_1$: holding temperature after cooling.

BEST MODE FOR CARRYING OUT THE INVENTION

Figure 1:
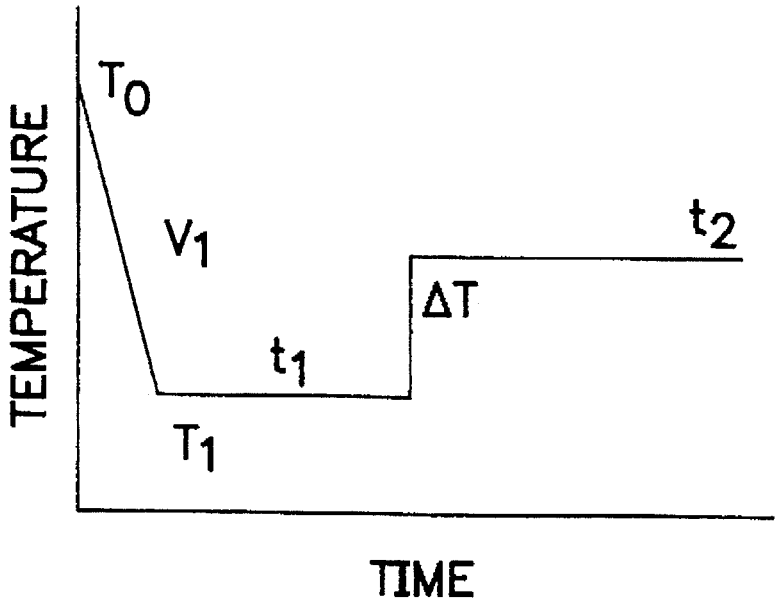
FIG. 1 is a diagram showing a heat treatment pattern of the present invention.

The invention will be explained in detail in the following.

The reasons for the restrictions on the chemical compositions of the bainite wire rod and wire according to this invention will now be discussed.

C is a fundamental element governing strength and ductility, strength increasing with higher carbon content. The lower limit of C content is set at 0.70% for ensuring. hardenability and strength and the upper limit is set at 1.20% for preventing formation of pro-eutectoid cementite.

Si is added at not less than 0.15% as a deoxidizing agent. Si is also an element which solid-solution hardens the steel and is further capable of reducing wire relaxation. However, since Si reduces the amount of scale formation, degrading mechanical scaling property, and also lowers the lubricity somewhat. The upper limit of Si content is therefore set at 1.00%.

Mn is added at not less than 0.30% as a deoxidizing agent. Although Mn is an element which strengthens the steel by its presence in solid solution, increasing the amount added increases the likelihood of segregation at the center portion of the wire rod. Since the hardenability of the segregated portion increases, shifting the finishing time of transformation toward the long period side, the untransformed portion becomes martensite, leading to wire breakage during drawing. The upper limit of Mn content is therefore set at 0.90%.

Although Al acts as a deoxidizer and is also the most economical element for obtaining fine-grained austenite by fixing N in the steel. The upper limit of N content is set at 0.100% in consideration of increase in nonmetallic inclusions and the lower limit is set at 0.006%, where the effect of Al appears.

Ti is already currently used in Ti-deoxidized steels, mainly for adjusting the austenite crystal grains of ordinary carbon steel. The upper limit of Ti content is set at 0.35% for suppressing increase of Ti inclusions and suppressing formation of solid solution carbo-nitrides in the steel. The lower limit is set at 0.01%, where these actions appear to an effective degree.

The wire rod and the wire of this invention contain one or more of the two elements Al and Ti.

Since S and P precipitate at the grain boundaries and degrade the steel properties, it is necessary to hold their contents as low as possible. The upper limit of S content is set at 0.01% and the upper limit of P content is set at 0.02 wt %.

Cr, an element which increases steel strength, is added as occasion demands. While increasing the amount of Cr increases strength, it also increases hardenability and moves the transformation finishing time line toward the long period side. Since this prolongs the time required for heat treatment, the upper limit of Cr content is set at 0.50%, while the lower limit thereof is set at 0.10% for increasing strength.

The reasons for the limitations in the production method of the present invention are as follows.

The cooling start temperature ($T_0$) following wire rod rolling or following wire heating affects the texture following transformation. The lower limit is set at not less than the austenite transformation point (755° C.), which is the equilibrium transformation start temperature. The upper limit is set at 1100° C. for suppressing abnormal austenite grain growth.

The cooling rate ($V_1$) following wire rod rolling or following wire heating is an important factor in suppressing the start of pearlite transformation. This was experimentally ascertained by the inventors. In the case of gradual cooling at an initial cooling rate of less than 60° C./sec, transformation starts on the high-temperature side of the pearlite transformation nose position, making it impossible to obtain a perfect bainite texture owing to formation of pearlite texture. While bainite texture forms at temperature under 500° C., formation of a perfect bainite texture requires rapid cooling at the initial cooling stage. The lower limit of the cooling rate ($V_1$) is therefore set at 60° C./sec, while the upper limit thereof is set at the industrially feasible 300° 0C./sec.

The isothermal holding temperature ($T_1$) after cooling is an important factor determining the formed texture. At a holding temperature exceeding 500° C., pearlite texture forming at the center portion of the wire rod or wire increases tensile strength and degrades drawability. At a holding temperature below 350° C., granulation of cementite in the bainite structure starts, increasing tensile strength and degrading drawability. The upper limit of the isothermal transformation temperature is therefore set at 500° C. and the lower limit thereof is set at 350° C.

Supercooled austenite texture is obtained by holding at 350°–500° C. for a specified period of time. When the temperature is increased thereafter, the cementite precipitation in the bainite texture which appears is coarser than in isothermal transformation. As a result, the two-step-transformed upper bainite texture softens.

In the case of complete two-stepped transformation, the supercooling time ($t_1$) required in the temperature range of 350°–500° C. is not less than the time required for formation of supercooled austenite and the upper limit thereof is up to prior to the start of bainite transformation. It is preferably not less than 1 sec and not more than X sec indicated by the following equation:

$$X=\exp(16.03-0.0307\times T_1,)$$

($T_1$: holding temperature after cooling).

The temperature rise ($\Delta T$) in the case of conducting two-stepped transformation after supercooling is set at a lower limit of 10° C., the temperature at which softening effect by two-stepped transformation appears, and since the upper limit of the temperature after temperature rise must not be more than 600° C. the lower limit is set at $\Delta T$ determined by the following equation:

$$\Delta T=600-T_1$$

($T_1$: holding temperature after cooling).

The holding time ($T_2$) after temperature increase is set as the period up to complete finishing of the transformation.

In the case of mixed two-stepped transformation after temperature increase, the supercooling time ($t_1$) required in the temperature range of 350°–500° C. is set at a period after the start of bainite transformation and of not more than Y sec determined by the following equation:

$$Y=\exp(19.83-0.0329\times T_1)$$

($T_1$: holding temperature after cooling).

As in the case of complete two-stepped transformation, the temperature rise ($\Delta T$) in the case of conducting two-stepped transformation after supercooling is set at a lower limit of 10° C., the temperature at which softening effect by two-stepped transformation appears, and since the upper limit of the temperature after temperature rise must not be more than 600° C. the lower limit is set at $\Delta T$ determined by the following equation:

$$\Delta T=600-T_1$$

($T_1$: holding temperature after cooling).

Pearlite texture forms at the wire rod or wire center portion in a pearlite wire rod or wire treated at a isothermal transformation temperature exceeding 500° C. Since pearlite texture has a laminar structure of cementite and ferrite, it makes a major contribution to work hardening, but a decrease in ductility cannot be prevented. In the high area reduction region, therefore, tensile strength increases with an accompanying degradation of twist characteristics, causing the occurrence of delamination.

In contrast, work hardening is suppressed in the wire rod or wire transformed in two steps according to this invention since it is in a state of coarse cementite dispersed in ferrite. As a result, it is possible to suppress occurrence of delamination and enable drawing up to the high area reduction region.

The bainite texture area ratio is measured from the observed sectional texture using the lattice point method. The area ratio is an important index indicating the state of bainite texture formation and influences the drawability. The lower limit of the area ratio is set at 80%, where the two-stepped transformation effect noticeably appears.

The Vickers hardness of the upper bainite structure is an important factor indicating the characteristics of the specimen. The cementite precipitation in a bainite wire rod or wire which has been two-step-transformed by conducting a cooling step and a temperature increasing step is coarser than in the case of isothermal transformation. As a result, the two-step-transformed upper bainite texture is softened. In consideration of effect on C content the upper limit of the Vickers hardness is set at not more than 450.

EXAMPLES

Example 1

Table 1 shows the chemical compositions of tested steel specimens.

A–D in Table 1 are invention steels and E and F are comparison steels.

Steel E has a C content exceeding the upper limit and steel F has a Mn content exceeding the upper limit.

The specimens were produced by casting 300×500 mm slabs with a continuous casting machine and then bloom pressing them into 122 - mm square slabs.

After these slabs had been rolled into wire rods, they were subjected to DLP (Direct Lead Parenting) cooling under the conditions indicated in Table 2.

The wire rods were drawn to 1.00 mmϕ at an average reduction of area of 17% and subjected to tensile test and twist test.

The tensile test was conducted using the No. 2 test piece of JISZ2201 and the method described in JISZ2241.

In the twist test, the specimen was cut to a test piece length of 100d+100 and rotated at a rotational speed of 10 rpm between chucks spaced at 100d. d represents the wire diameter.

The characteristic values obtained in this manner are also shown in Table 2.

No. 1–No. 4 are invention steels.

No. 5–No. 10 are comparative steels.

In comparative steel No. 5, pearlite which formed because the cooling rate was too slow reduced the drawability, leading to breakage during drawing.

In comparative steel No. 6, two-step-transformed bainite texture did not form because the temperature rise was too low, reducing the drawability and leading to breakage during drawing.

In comparative steel No. 7, martensite formed because a sufficient isothermal transformation period was not secured, reducing the drawability and leading to breakage during drawing.

In comparative steel No. 8, the ratio of two-step-transformed bainite texture decreased because the super-cooling treatment time was long, reducing the drawability and leading to breakage during drawing.

In comparative steel No. 9, pro-eutectoid cementite which formed because the C content was too high reduced the drawability.

In comparative steel No. 10, micromartensite which formed in conjunction with central segregation caused by an excessively high Mn content reduced the drawability.

The specimens were produced by casting 300×500 mm slabs with a continuous casting machine, bloom pressing them into 122 - mm square slabs, and producing wire from these slabs.

After heating, these wires were subjected to DLP (Direct Lead Patenting) cooling under the conditions indicated in Table 4.

The wire were drawn to 1.00 mmϕ at an average reduction of area of 17% and subjected to tensile test and twist test.

The tensile test was conducted using the No. 2 test piece of JISZ2201 and the method described in JISZ2241.

In the twist test, the specimen was cut to a test piece length of 100d+100 and rotated at a rotational speed of 10 rpm between chucks spaced at 100d. d represents the wire diameter.

The characteristic values obtained in this manner are also shown in Table 4.

No. 1–No. 4 are invention steels.

TABLE 1

Chemical Compositions of Tested Steel Specimens

| | Chemical Compositions (wt %) | | | | | | | | | | |
|---|---|---|---|---|---|---|---|---|---|---|---|
| Symbol | C | Si | Mn | P | S | Cr | Al | Ti | N | O | Remark |
| A | 0.960 | 0.18 | 0.40 | 0.012 | 0.009 | 0.25 | — | 0.30 | 0.0054 | 0.0029 | Invention |
| B | 0.930 | 0.15 | 0.30 | 0.010 | 0.008 | 0.28 | 0.080 | 0.01 | 0.0031 | 0.0030 | Invention |
| C | 1.120 | 0.16 | 0.39 | 0.013 | 0.007 | 0.35 | 0.070 | — | 0.0034 | 0.0025 | Invention |
| D | 0.900 | 0.20 | 0.35 | 0.015 | 0.008 | — | — | 0.02 | 0.0055 | 0.0036 | Invention |
| E | 1.290 | 0.11 | 0.40 | 0.018 | 0.008 | 0.20 | 0.010 | 0.01 | 0.0034 | 0.0037 | Comparison |
| F | 0.980 | 0.30 | 1.80 | 0.016 | 0.009 | 0.22 | 0.010 | 0.01 | 0.0037 | 0.0029 | Comparison |

TABLE 2

Wire Rod Rolling Conditions and Characteristic Values of Tested Steel Specimens

| | | | | | Cooling tank | | | | Rolled wire rod | | | | After drawing (diameter: 1.00 mm) | | | | |
|---|---|---|---|---|---|---|---|---|---|---|---|---|---|---|---|---|---|
| No. | Symbol | Diameter mmϕ | $T_0$ °C. | $V_1$ °C./s | $T_1$ °C. | $t_1$ s | ΔT | $t_2$ s | TS kgf/mm² | Reduction % | Bainite texture ratio % | Hv | TS kgf/mm² | Reduction % | Twist value (times) | Delamination | Remark |
| 1 | A | 4.0 | 950 | 120 | 450 | 10 | 50 | 90 | 140 | 50 | 95 | 430 | 260 | 40 | 25 | No | Invention |
| 2 | B | 4.5 | 1000 | 150 | 470 | 15 | 50 | 90 | 130 | 53 | 90 | 420 | 275 | 42 | 30 | No | Invention |
| 3 | C | 5.0 | 1050 | 200 | 480 | 10 | 60 | 110 | 140 | 58 | 90 | 420 | 280 | 43 | 28 | No | Invention |
| 4 | D | 5.5 | 800 | 160 | 490 | 5 | 150 | 300 | 120 | 55 | 85 | 450 | 268 | 41 | 26 | No | Invention |
| 5 | A | 5.0 | 1000 | 50 | 450 | 20 | 100 | 150 | 150 | 25 | 30 | 550 | | Broke at 1.3 mmϕ | | | Comparison |
| 6 | B | 5.0 | 1050 | 130 | 550 | 20 | 0 | 150 | 145 | 46 | 50 | 480 | | Broke at 1.2 mmϕ | | | Comparison |
| 7 | C | 5.5 | 1100 | 120 | 490 | 2 | 60 | 30 | 170 | 15 | 60 | 550 | | Broke at 1.4 mmϕ | | | Comparison |
| 8 | D | 5.5 | 740 | 120 | 480 | 50 | 50 | 100 | 140 | 45 | 0 | 460 | | Broke at 1.3 mmϕ | | | Comparison |
| 9 | E | 5.5 | 1050 | 130 | 480 | 10 | 40 | 100 | 160 | 35 | 70 | 550 | 290 | 20 | 13 | Yes | Comparison |
| 10 | F | 5.5 | 1050 | 120 | 470 | 15 | 80 | 130 | 170 | 13 | 60 | 600 | 270 | 35 | 19 | Yes | Comparison |

$T_0$: Cooling start temperature
$T_1$: Holding temperature after cooling
ΔT: Temperature rise
$V_1$: Cooling rate
$t_1$: Holding time after cooling
$t_2$: Heat treatment time

Example 2

Table 3 shows the chemical compositions of tested steel specimens.

A–D in Table 3 are invention steels and E and F are comparison steels.

No. 5–No. 10 are comparative steels.

In comparative steel No. 5, pearlite which formed because the cooling rate was too slow reduced the drawability, leading to breakage during drawing.

In comparative steel No. 6, two-step-transformed bainite texture did not form because the temperature rise was too low, reducing the drawability and leading to breakage during drawing.

In comparative steel No. 7, martensite formed because a sufficient isothermal transformation period was not secured, reducing the drawability and leading to breakage during drawing.

In comparative steel No. 8, the ratio of two-step-transformed bainite texture decreased because the super-cooling treatment time was long, reducing the drawability and leading to breakage during drawing.

In comparative steel No. 9, pro-eutectoid cementite which formed because the C content was too high reduced the drawability.

In Comparative steel No. 10, micromartensite which formed in conjunction with central segregation caused by an excessively high Mn content reduced the drawability.

TABLE 3

Chemical Compositions of Tested Steel Specimens

| | Chemical Compositions (wt %) | | | | | | | | | | |
|---|---|---|---|---|---|---|---|---|---|---|---|
| Symbol | C | Si | Mn | P | S | Cr | Al | Ti | N | O | Remark |
| A | 0.960 | 0.18 | 0.40 | 0.012 | 0.009 | 0.25 | — | 0.30 | 0.0054 | 0.0029 | Invention |
| B | 0.930 | 0.15 | 0.30 | 0.010 | 0.008 | 0.28 | 0.080 | 0.01 | 0.0031 | 0.0030 | Invention |
| C | 1.120 | 0.16 | 0.39 | 0.013 | 0.007 | 0.35 | 0.070 | — | 0.0034 | 0.0025 | Invention |
| D | 0.900 | 0.20 | 0.35 | 0.015 | 0.008 | — | — | 0.02 | 0.0055 | 0.0036 | Invention |
| E | 1.290 | 0.11 | 0.40 | 0.018 | 0.008 | 0.20 | 0.010 | 0.01 | 0.0034 | 0.0037 | Comparison |
| F | 0.980 | 0.30 | 1.80 | 0.016 | 0.009 | 0.22 | 0.010 | 0.01 | 0.0037 | 0.0029 | Comparison |

TABLE 4

Wire Heat Treatment Conditions and Characteristic Values of Tested Steel Specimens

| | | | | | Cooling tank | | | | After heat treatment, before drawing | | | | After drawing (diameter: 1.00 mm) | | | | |
|---|---|---|---|---|---|---|---|---|---|---|---|---|---|---|---|---|---|
| No. | Symbol | Diameter mmϕ | $T_0$ °C. | $V_1$ °C./s | $T_1$ °C. | $t_1$ s | ΔT | $t_2$ s | TS kgf/mm² | Reduction % | Bainite texture ratio % | Hv | TS kgf/mm² | Reduction % | Twist value (times) | Delamination | Remark |
| 1 | A | 3.0 | 950 | 120 | 450 | 10 | 50 | 90 | 140 | 50 | 95 | 430 | 240 | 40 | 25 | No | Invention |
| 2 | B | 4.0 | 1000 | 150 | 450 | 15 | 50 | 90 | 130 | 53 | 90 | 420 | 255 | 42 | 30 | No | Invention |
| 3 | C | 4.5 | 1050 | 200 | 400 | 10 | 60 | 110 | 140 | 58 | 90 | 420 | 270 | 43 | 28 | No | Invention |
| 4 | D | 5.5 | 800 | 160 | 490 | 5 | 150 | 300 | 120 | 55 | 85 | 450 | 268 | 41 | 26 | No | Invention |
| 5 | A | 5.0 | 1000 | 30 | 450 | 20 | 100 | 150 | 150 | 25 | 30 | 550 | | Broke at 1.3 mmϕ | | | Comparison |
| 6 | B | 5.0 | 1050 | 130 | 550 | 20 | 0 | 150 | 145 | 46 | 50 | 480 | | Broke at 1.2 mmϕ | | | Comparison |
| 7 | C | 4.8 | 1100 | 120 | 490 | 2 | 60 | 25 | 170 | 15 | 60 | 550 | | Broke at 1.4 mmϕ | | | Comparison |
| 8 | D | 5.0 | 740 | 120 | 480 | 70 | 50 | 100 | 140 | 45 | 0 | 460 | | Broke at 1.3 mmϕ | | | Comparison |
| 9 | E | 5.0 | 1050 | 130 | 480 | 10 | 40 | 100 | 140 | 35 | 70 | 550 | 290 | 20 | 13 | Yes | Comparison |
| 10 | F | 3.5 | 1050 | 120 | 470 | 15 | 80 | 130 | 170 | 13 | 60 | 600 | 270 | 35 | 19 | Yes | Comparison |

$T_0$: Heating temperature
$T_1$: Holding temperature after cooling
ΔT: Temperature rise
$V_1$: Cooling rate
$t_1$: Holding time after cooling
$t_2$: Heat treatment time

INDUSTRIAL APPLICABILITY

As discussed in the foregoing, since the high-carbon steel wire rod or wire produced in accordance with this invention can be drawn to an appreciably higher reduction of area than possible by the prior art method, it has improved delamination resistance property.

The present invention enables production of high-carbon steel wire rod and wire excellent in drawability, elimination of intermediate heat treatment in the secondary processing step, a large reduction in cost, a shortening of production period, and a reduction of equipment expenses.

We claim:

1. High-carbon steel wire rod or wire excellent in drawability which consists essentially of in weight percent,

C: 0.70–1.20%,

Si: 0.15–1.00% and

Mn: 0.30–0.90%, further consisting essentially of as alloying components one or both of Al: 0.006–0.100% and Ti: 0.01–0.35%, is limited to P: not more than 0.02% and S: not more than 0.01%, the remainder being Fe and unavoidable impurities, and has a microstructure of, in terms of area ratio, not less than 80% upper bainite texture obtained by two-stepped transformation and an Hv of not more than 450.

2. High-carbon steel wire rod or wire excellent in drawability according to claim 1 further consisting essentially of Cr 0.10–0.50% as an alloying component.

3. A method of producing high-carbon steel wire rod excellent in drawability which comprises, rolling into wire rod a steel slab of a composition which contains, in weight percent,

C: 0.70–1.20%,

Si: 0.15–1.00% and

Mn: 0.30–0.90%, further contains as alloying components one or both of

Al: 0.006–0.100% and

Ti: 0.01–0.35%, is limited to

P: not more than 0.02% and

S: not more than 0.01%, the remainder being Fe and unavoidable impurities, cooling the rolled wire rod from a temperature range of 1100°–755° C. to a temperature range of 350°–500° C. at a cooling rate of 60°–300° C./sec, and holding it in this temperature range for a specified time period within the range in which bainite transformation does not begin or within a range from after the start of bainite transformation to prior to completion of bainite transformation, and increasing the temperature and holding it until bainite transformation is completely finished.

4. A method of producing high-carbon steel wire rod excellent in drawability according to claim 3 wherein the starting slab further contains Cr: 0.10–0.50% as an alloying component.

5. A method of producing high-carbon steel wire rod excellent in drawability according to claim 3 which comprises, after the starting slab has been rolled into wire rod, cooling the rolled wire rod from the temperature range of 1100°–755° C. to the temperature range of 350°–500° C. at a cooling rate of 60°–300° C./sec, holding it in this temperature range for not less than 1 sec and not more than a period within the range in which bainite transformation does not begin of X sec determined by the following equation (1), and increasing the temperature not less than 10° C. and not more than 600–$T_1$ ($T_1$: holding temperature after cooling) °C. and holding it until bainite transformation is completely finished, $$X=\exp(16.03-0.0307\times T_1) \quad (1)$$

where $T_1$: holding temperature after cooling.

6. A method of producing high-carbon steel wire rod excellent in drawability according to claim 3 which comprises, after the starting slab has been rolled into wire rod, cooling the rolled wire rod from the temperature range of 1100°–755° C. to the temperature range of 350°–500° C. at a cooling rate of 60°–300° C./sec, holding it in this temperature range for a period from after the start of bainite transformation to prior to completion of bainite transformation, specifically for a period of not more than Y sec determined by the following equation (2), and increasing the temperature not less than 10° C. and not more than 600–$T_1$ ($T_1$: holding temperature after cooling) °C. and holding it until bainite transformation is completely finished, $$Y=\exp(19.83-0.0329\times T_1) \quad (2)$$

where $T_1$: holding temperature after cooling.

7. A method of producing high-carbon steel wire excellent in drawability which comprises, heating to a temperature range of 1100°–755° C. wire of a composition which contains, in weight percent,

C: 0.70–1.20%,

Si: 0.15–1.00% and

Mn: 0.30–0.90%, further contains as alloying components one or both of

Al: 0.006–0.100% and

Ti: 0.01–0.35% is limited to

P: not more than 0.02% and

S: not more than 0.01%, the remainder being Fe and unavoidable impurities, cooling the heated wire to a temperature range of 350°–500° C. at a cooling rate of 60°–300° C./sec, and holding it in this temperature range for a specified time period within the range in which bainite transformation does not begin or within a range from after the start of bainite transformation to prior to completion of bainite transformation, and increasing the temperature and holding it until bainite transformation is completely finished.

8. A method of producing high-carbon steel wire excellent in drawability according to claim 7 wherein the starting wire further contains Cr: 0.10–0.50% as an alloying component.

9. A method of producing high-carbon steel wire excellent in drawability according to claim 7 which comprises, cooling the starting wire from the temperature range of 1100°–755° C. to the temperature range of 350°–500° C. at a cooling rate of 60°–300° C./sec, holding it in this temperature range for not less than 1 sec and not more than a period within the range in which bainite transformation does not begin of X sec determined by the following equation (1), and increasing the temperature not less than 10° C. and not more than 600–$T_1$ ($T_1$: holding temperature after cooling) °C. and holding it until bainite transformation is completely finished, $$X=\exp(16.03-0.0307\times T_1) \quad (1)$$

where $T_1$: holding temperature after cooling.

10. A method of producing high-carbon steel wire excellent in drawability according to claim 7 which comprises, cooling the starting wire from the temperature range of 1100°–755° C. to the temperature range of 350°–500° C. at a cooling rate of 60°–300° C./sec, holding it in this temperature range for a period from after the start of bainite transformation to prior to completion of bainite transformation, specifically for a period of not more than Y sec determined by the following equation (2), and increasing the temperature not less than 10° C. and not more than 600–$T_1$ ($T_1$: holding temperature after cooling) °C. and holding it until bainite transformation is completely finished, $$Y=\exp(19.83-0.0329\times T_1) \quad (2)$$

where $T_1$: holding temperature after cooling.

* * * * *